United States Patent [19]

Hemmer et al.

[11] 4,374,604

[45] Feb. 22, 1983

[54] CONTACT FOR AN ELECTRICAL CONNECTOR

[75] Inventors: Valentine J. Hemmer; R. Amelia Piscitelli, both of Sidney; Charles P. Fischer; James C. Washburn, both of Bainbridge, all of N.Y.

[73] Assignee: The Bendix Corporation, Southfield, Mich.

[21] Appl. No.: 240,735

[22] Filed: Mar. 5, 1981

[51] Int. Cl.[3] ..... H01R 13/40

[52] U.S. Cl. ..... 339/59 R

[58] Field of Search ..... 339/59–61, 339/217 S, 276 A; 174/153 R

[56] References Cited

U.S. PATENT DOCUMENTS

| | | | |
|---|---|---|---|
| 3,165,369 | 1/1965 | Maston | 339/217 |
| 3,221,292 | 11/1965 | Swanson et al. | 339/59 |
| 3,638,165 | 1/1972 | Anhalt et al. | 339/59 R |
| 3,638,165 | 1/1972 | Anhalt et al. | 339/59 R |
| 3,938,874 | 2/1976 | Bourdon | 339/217 S |
| 3,938,874 | 2/1976 | Bourdon | 339/217 S |
| 4,127,314 | 11/1978 | Hasimoto | 339/59 M |
| 4,127,314 | 11/1978 | Hasimoto | 339/59 M |

*Primary Examiner*—Joseph H. McGlynn
*Assistant Examiner*—Paula Austin
*Attorney, Agent, or Firm*—Raymond J. Eifler

[57] ABSTRACT

In order to prevent the rotation of an electrical contact 30 within a connector assembly housing 3 the contact 30 is provided with a plurality of radial fins 37 which are located within a space between resiliently deflectable fingers 21 which are part of the contact retaining insert 20. Because the contact 30 does not rotate, the winding of a wire around the wire receiving portion 38 of the contact is facilitated.

3 Claims, 15 Drawing Figures

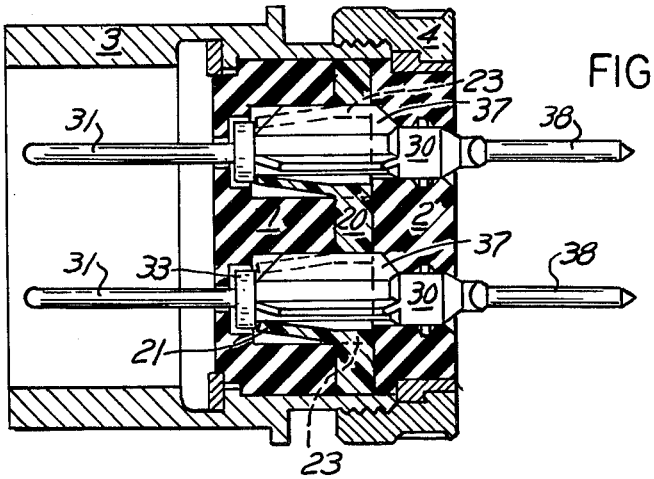
FIG. 15
FIG. 11
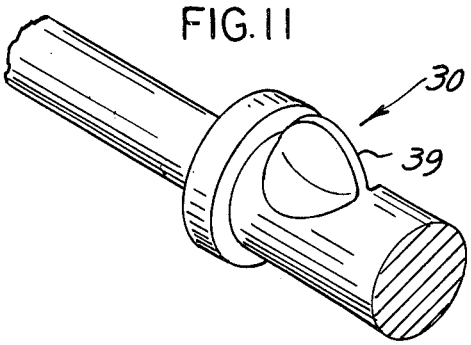
FIG. 12
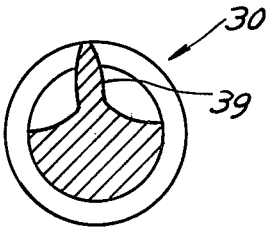
FIG. 13
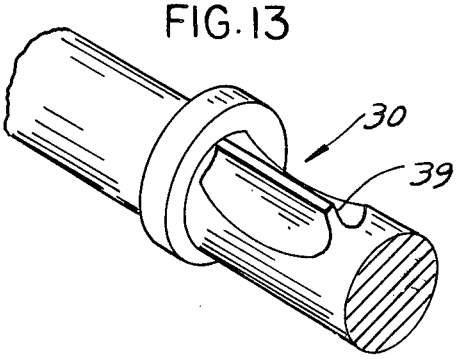
FIG. 14
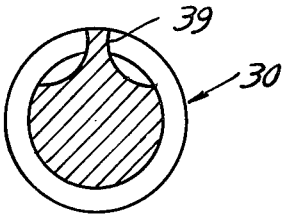

CONTACT FOR AN ELECTRICAL CONNECTOR

This invention relates to electrical connectors and more particularly to an electrical contact mounted within the connector.

Electrical connectors generally include a plug and receptacle, each of which has an insert of dielectric material provided with multiple openings within which electrical contacts are retained. The insert is introduced from the rearward end of the metallic metal shell where it is held in place by some means, such as a nut. Some connectors provide for rearward insertion and front or rear release of electrical contacts. While others provide for front insertion and front or rear release of electrical contacts. These features are desirable and facilitate the assembly and servicing of the connector. Examples of a prior art electrical connector having insertable and removable contacts may be found in U.S. Pat. No. 3,165,369 entitled "Retention System for Electrical Contacts" issued Jan. 12, 1966; and U.S. Pat. No. 3,221,292 entitled "Electrical Connector" issued Nov. 30, 1965. In the foregoing types of connectors, the electrical contacts have a mating end and a wire receiving end. Incoming wires are attached to the wire receiving end of the contact by one of three methods, i.e., soldering, crimping or wrapping the wire around the rear end of the contact. This invention is specifically related to contacts wherein wires are wrapped around the contact to obtain an electrical connection. Since each connector assembly contains multiple contacts sometimes as many as 50 to 100 contacts. Wire wrapping tools are used to rotate a wire around the contact. The wire wrapping tool is similar to a drill in that a wire, attached to the forward portion of the tool, is placed against the contact so that when the tool rotates the wire is wrapped around the contact. Unfortunately, in many instances when the wire is rotated to wrap around the contact, the contact rotates and prevents the wire from wrapping tightly around the contact. This results in a poor electrical connection.

DISCLOSURE OF THE INVENTION

This invention provides a cylindrical electrical contact for a connector that will not rotate once it is mounted within the connector. The invention is characterized by an electrical contact having a radial projection which mates with a groove within an insert in the connector assembly to prevent the contact from rotating.

Accordingly, it is an advantage of this invention to provide an electrical contact that will not rotate once it is mounted within a connector assembly.

DETAILED DESCRIPTION OF THE INVENTION

FIGS. 11–14 ilustrate other alternate embodiments of the invention.

FIG. 15 illustrates an electrical connector assembly incorporating the principles of the invention.

Figure 1:
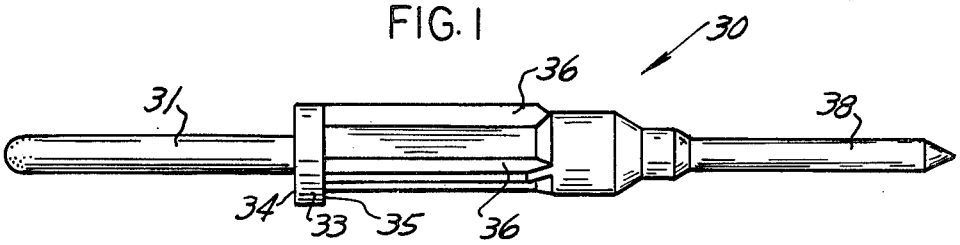
FIGS. 1 through 5 illustrate a portion of electrical connector assembly incorporating the principles of this invention.

Referring now to the drawings, FIG. 1 illustrates an electrical contact embodying the principles of the invention. The electrical contact 30 is generally machined from a piece of beryllium copper and includes a forward mating portion 31, a rear wiring receiving portion 38, an enlarged middle portion 33 and a plurality of radial fins 36. The forward mating portion 31 may be either a round pin type mating portion, which is shown, or a socket type mating portion (not shown). The rear wire receiving end 38 is generally rectangularly shaped so that a wire may more easily be wound around the contact without slipping during the winding. The enlarged portion 33 of the contact includes a forwardly facing shoulder 34 and a rearwardly facing shoulder 35 which are adapted to engage shoulders located in inserts within the connector assembly to retain the contact in a fixed position in the assembly.

Figure 2:
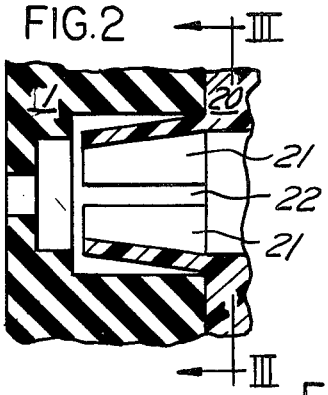

FIG. 2 shows a partial view of the forward insert 1 and the contact retaining insert 20 of a connector assembly. The retention mechanism is more completely explained in U.S. Pat. No. 3,165,369 and includes a plurality of resiliently deflectable fingers 21 having a slot 22 between the fingers. The resiliently deflectable fingers 21 deflect outwardly when the enlarged portion of a contact passes the deflectable fingers 21 and snaps back into their original position behind a shoulder on the contact to retain the contact. The contact retaining insert 20 and forward insert 1 are generally comprised of a hard dielectric material made from a polymide or polycarbonate.

Figure 3:
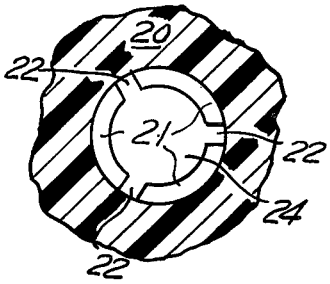

FIG. 3 is a partial view of the contact retaining insert 20 taken along lines III—III of FIG. 2 and illustrates a bore 24 through the insert 20 and three resiliently deflectable fingers 21 each separated by a respective slot 22.

Figure 4:
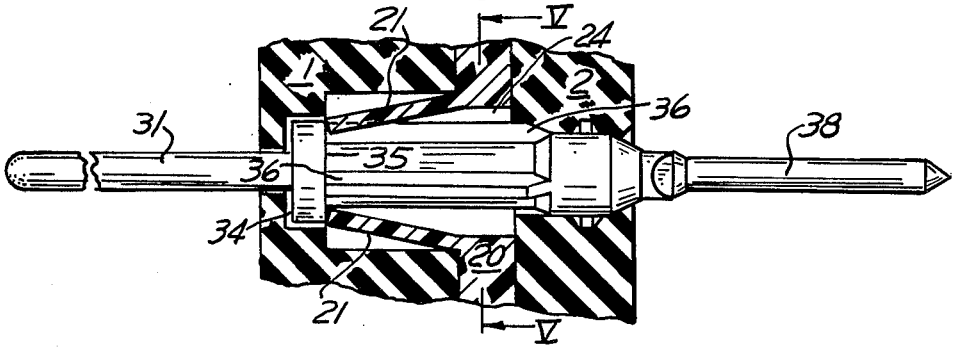

FIG. 4 is a partial view of a connector assembly illustrating the contact 30 mounted within the connector by a forward insert 1, a rear insert 2 and the contact retention insert 20. This Figure illustrates how the resiliently deflectable fingers 21 locate behind the rearwardly facing shoulder 35 of the contact 30 to retain the contact 30 in a fixed position within the connector assembly. The forwardly facing shoulder 34 of the contact abuts an internal shoulder in the forward insert 1 to prevent the contact 30 from moving forward. When the contact is inserted into the contact assembly the radial fins 36 of the contact 30 are arranged to mate with the slots between the deflectable fingers 21 of the contact retaining insert 20. The rear insert 2 provides a moisture seal and is generally comprised of a soft pliable material such as rubber.

Figure 5:
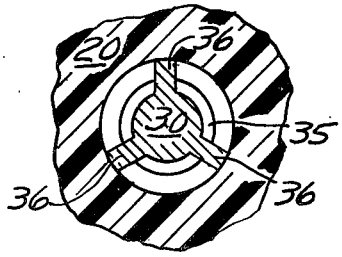

FIG. 5 is a cross-sectional view taken along lines V—V in FIG. 4 and illustrates how the radial fins 36 are located in the slots (22, FIG. 3) between the resiliently deflectable fingers 21. When the radial fins 36 are located within the slots between the resiliently deflectable fingers 21 the contact cannot be rotated.

Figure 6:
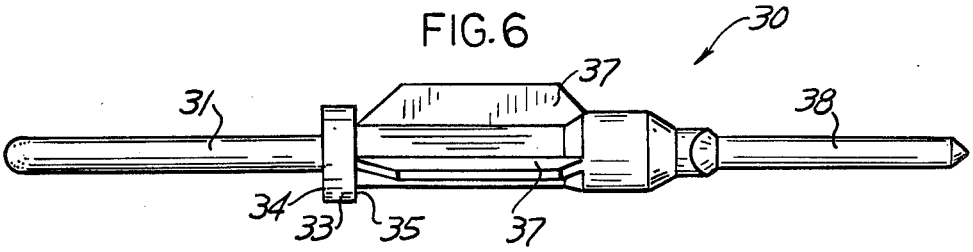
FIGS. 6 through 10 illustrate an alternate embodiment of the invention.

FIG. 6 illustrates an alternate embodiment of the invention wherein the contact 30 includes radial fins 37 that extend radially beyond the enlarged portion 33 of the contact.

Figure 7:
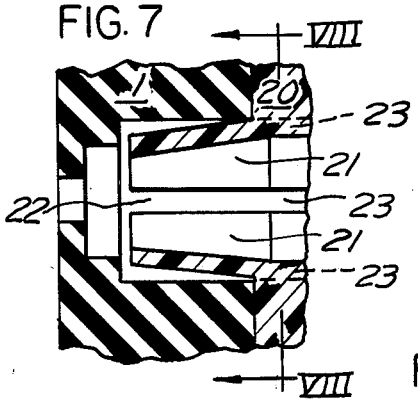

FIG. 7 is an enlarged view of the contact retaining insert 20 that will cooperate with a contact to retain a contain within a connector assembly. The fins (37, FIG. 1) are adopted to mate with slots 22 and grooves 23 in the contact retaining insert 20.

Figure 8:
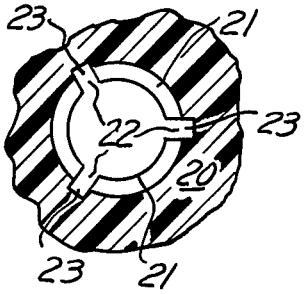

FIG. 8 is a cross-sectional view of the contact retaining insert 20 taken along lines VIII—VIII of FIG. 7 illustrating the slots 22 between the resiliently deflectable fingers 21 and the axial groove 23 in the wall of the passage in the insert 20.

Figure 9:
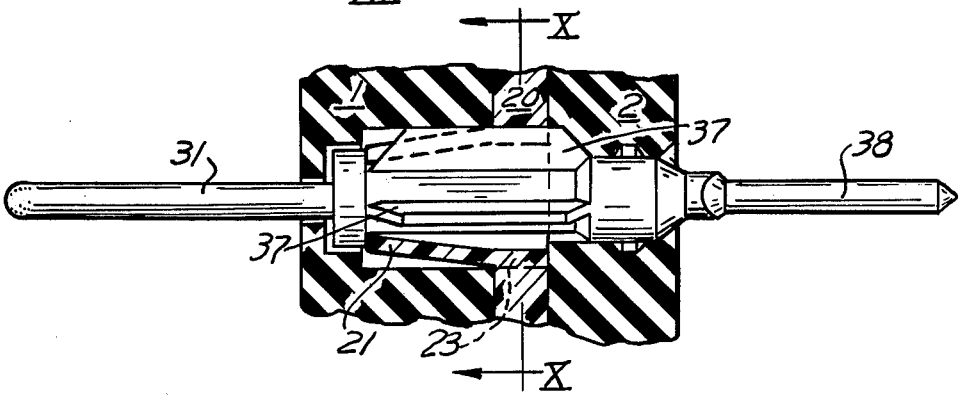

FIG. 9 illustrates how the contact shown in FIG. 6 is mounted in electrical connector assembly having a contact retaining insert of the type shown in FIG. 7 and 8.

Figure 10:
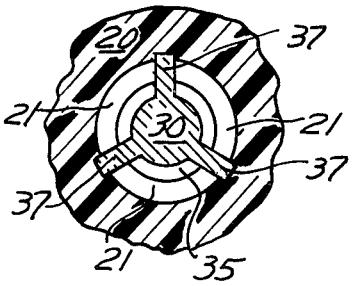

FIG. 10 is a cross-sectional view of the contact retaining insert 20 and contact 30 taken along lines X—X of FIG. 9 and illustrates how the radial fins 37 of the contact 30 are located in the contact retaining insert 20 to prevent the contact from rotating.

FIGS. 11 and 12 illustrate another embodiment of a contact 30 wherein a radial projection 39 has been coined into the contact 30.

FIGS. 13 and 14 illustrate another configuration of a radial projection 30 which has been coined into the contact 30.

FIG. 15 illustrates a complete connector assembly having at least one contact mounted therein that incorporates the principles of the invention. The complete electrical connector assembly includes an outer shell 3 and a rear nut 4 to hold the inserts 1, 2 and 20 in place within the assembly.

Having described the invention what is claimed is:

1. In combination with an electrical connector assembly of the type having a housing; an electrically nonconducting insert mounted within the housing, said insert including at least one bore extending therethrough and means for retaining a contact assembly in each bore of said insert said means including a plurality of resiliently deflectable fingers and a slot separating adjacent fingers; and an electrical contact mounted in each of said bores, each contact including a forward mating portion, a rear wire receiving portion and an enlarged middle portion having forwardly and rearwardly facing shoulders one of said shoulders engaging said deflectable fingers to retain said contact in said bore; the improvement wherein;

each of said contact assemblies includes a radial projection located at the rear wire receiving portion of said contact, said projection extending into the slot separating the deflectable fingers whereby, each of said contact assemblies is prevented from rotating in said bore.

2. The contact as recited in claim 1 wherein said projection extends radially beyond the enlarged middle portion of said contact.

3. The contact as recited in claim 1 wherein said radial projection is elongated axially.

* * * * *